US005109735A

United States Patent [19]

Hart

[11] Patent Number: 5,109,735

[45] Date of Patent: May 5, 1992

[54] HIGH STRENGTH QUICK CHANGE KEY TYPE INSTALLATION TOOL

[75] Inventor: Dale Hart, Seal Beach, Calif.

[73] Assignee: Hi-Shear Corporation, Torrance, Calif.

[21] Appl. No.: 385,489

[22] Filed: Jul. 25, 1989

[51] Int. Cl.[5] ..... B25B 17/00

[52] U.S. Cl. ..... 81/56; 81/55

[58] Field of Search ..... 81/56, 55

[56] References Cited

U.S. PATENT DOCUMENTS

| | | | |
|---|---|---|---|
| 2,882,773 | 4/1959 | Wing | 81/56 |
| 3,027,789 | 3/1962 | Bochman | 81/56 |
| 4,617,844 | 10/1986 | Batten | 81/56 |

*Primary Examiner*—Bruce M. Kisliuk
*Assistant Examiner*—Lawrence Cruz
*Attorney, Agent, or Firm*—Donald D. Mon

[57] ABSTRACT

A power driven torque tool for turning a socket to set a threaded fastener. A socket drive to drive the socket from its side has a passage through which a key passes. The key is held in a key holder which itself is held against rotation by a bias spring that biases the key away from the socket, and by holding the key holder against rotation also holds the key against rotation. The key can quickly be changed by releasing the spring from the key holder, changing the key, and then reattaching the spring.

4 Claims, 1 Drawing Sheet

HIGH STRENGTH QUICK CHANGE KEY TYPE INSTALLATION TOOL

FIELD OF THE INVENTION

This invention relates to installation tools for setting threaded fasteners, especially fasteners which are set by tool engagement at only one end.

BACKGROUND OF THE INVENTION

Some classes of threaded fasteners are intended to be set by tool engagement at only one end. An example is the well known Hi-Lok fastener sold by Hi-Shear Corporation of Torrance, Calif., exemplified by U.S. Pat. No. 2,940,495 to Wing.

Such fasteners have a non-circular, usually hexagonal array of driving surfaces on their internally threaded collars, and a non-circular, usually hexagonal array of wrench engaging surfaces in the end of their externally threaded pin. A wrench to set this fastener includes a power driven socket to engage the collar, and a non-rotating key to engage in the pin recess. When the collar is turned and the pin is restrained, the collar is tightened down onto the pin and the fastener is set An example of such a wrench is shown in U.S. Pat. No. 2,882,773 to Wing, which is incorporated herein in its entirety for its showing of the general properties of such a tool.

Pervasive problems with this type of tool are the tendency of the key to twist or otherwise deform, and the fact that changing the key after damage, or changing it to a different size, is a relatively slow procedure.

It is an object of this invention to provide a key for such a wrench which has an improved resistance to twisting deformation, or bending.

It is another object of this invention to provide a tool whose key can quickly be changed to a different size, or to replace a damaged key.

BRIEF DESCRIPTION OF THE INVENTION

A tool according to this invention has a body adapted to be connected to a source of setting torque, such as an air motor A gear train drives a rotatable drive socket The drive socket has an open end to receive a collar to be driven, and has an array of fastener-engaged surfaces to engaging the collar.

A passage through the socket passes a key which projects beyond the socket to engage in a non-circular recess in a fastener pin. The key is held in a key holder that is fitted in the socket passage. It is rotationally free of the socket.

A spring is fixed to the tool body, and is placed in compression against the key and the key holder to bias them toward the fastener pin.

According to a preferred feature of this invention, the spring also holds the key and key holder against rotation, absorbing some shock load which further protects the key.

According to yet another preferred but optional feature of this invention, the key has only a short length of minimum cross-section, where it fits into the recess. The remainder of the key has a larger cross-section which is more resistant to twisting deformation.

The above and other features of this invention will be fully understood from the following detailed description and the accompanying drawings, in which:

DETAILED DESCRIPTION OF THE DRAWINGS

Figure 3:
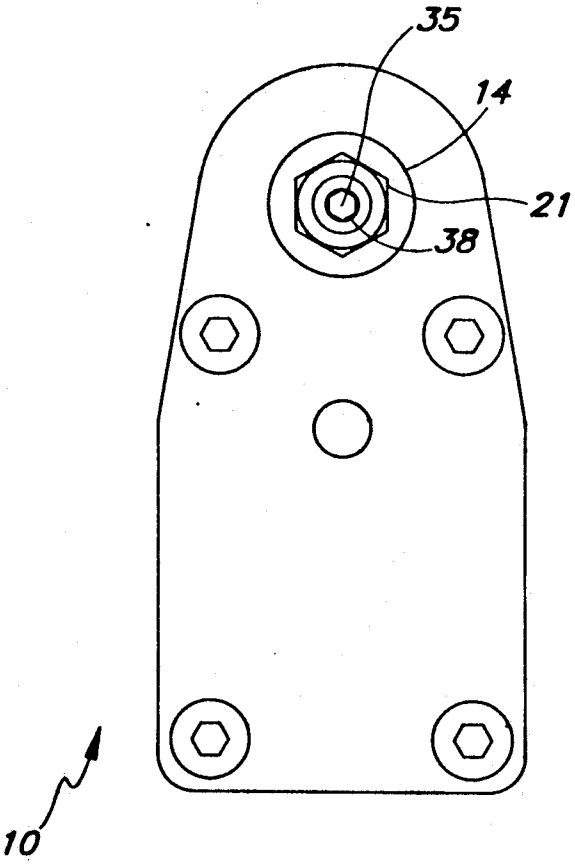
FIG. 3 is a right hand side view of FIG. 1.

Tool 10 has a body 11 adapted to receive driving torque from a power source (not shown) such as an air motor. An input shaft (not shown) in sleeve 12 drives a gear train 13 housed in the body. The gear train transfers the power laterally, and is engaged to a socket drive or directly to a socket 14 carried by the socket drive. The socket has teeth 15 around its periphery which engage with teeth at the output end of the gear train.

The socket is rotatably fitted in the body. It has an open end 20 with a non-circular array 21 of fastener engaging surfaces. As shown in FIG. 3, this will be a hexagonal array when a hexagonal collar is to be set. Alternatively it can have any shape suited to a respective fastener.

The socket also has a circular passage 22 through it. A key holder 23 is fitted in this passage. It has a circular external bearing surface 24 that permits the key holder to be restrained by the spring against rotation, but which permits the socket or socket holder to rotate relative to it. It has a key passage 25 with a first non-circular (preferably hexagonal) interior wall 26, a shoulder 27, and a reduced passage 28. A port 29 through wall 26 admits the free end 30 of a coil spring 31. The spring is anchored to the body and is conformed so that its free end exerts an axial biasing force toward the body.

A key 35 has a first non-circular segment 36 which fits closely in wall 26. A shoulder **36*a* on the key presses against shoulder 27. A shaft portion 37*a* fits in reduced passage 28, and a reduced fastener engaging position 38 projects beyond the key holder. Attention is called to the feature that the cross-section area of portion 38** is smaller than the cross-section area of the remainder of the key, and that the fastener-engaging portion is a relatively small proportion of the total length of the key. The fastener-engaging portion is supported against twisting by the fastener pin itself, and the remainder of the key is heavier. This arrangement significantly reduces the risk of twisting failure of the key.

Figure 2:
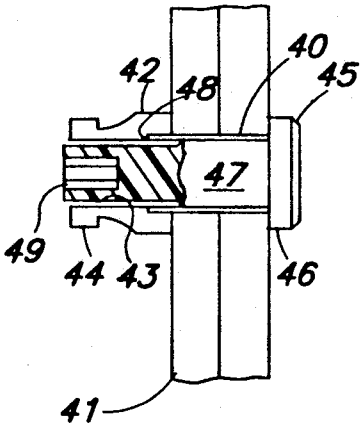
FIG. 2 is a side view, partly in cutaway cross-section, showing a fastener which can be set by this tool.
Figure 1:
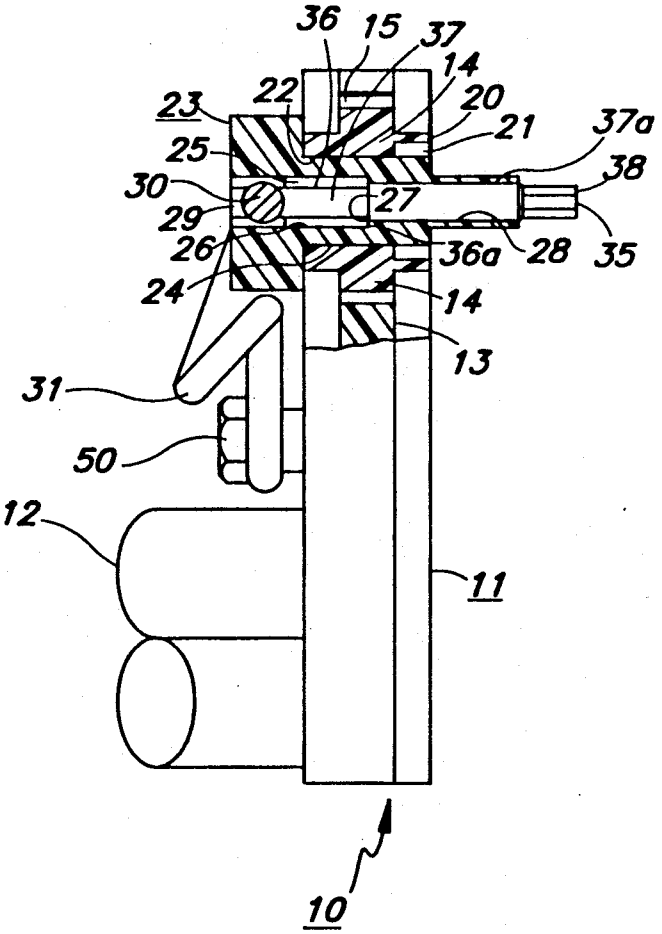
FIG. 1 is a side view, partly in cutaway cross-section, showing the presently-preferred embodiment of the invention.

A fastener 40 to be set by this tool is shown is FIG. 2, being installed in a workpiece 41. Its collar 42 has an internally threaded passage 43 and an external array 44 of fastener engaging surfaces, usually hexagonal.

The pin 45 of the fastener has a head 46, a shank 47 and an external thread 48. It has a non-circular key-engaging recess 49 in its end to receive the end of the pin. When the socket and the key are engaged to the fastener, the socket is turned and the key is restrained to set the fastener from only one end.

Instead of being provided with a port to receive the end of the spring, the key holder could have an open lateral slot. The spring serves two functions- it extends across the passage in the key holder to hold the key in, and biases the key and the key holder (which one it presses against is not important) to bias the key toward the fastener. It also permits the key to retract toward the body, as it must when the pin advances through the collar. Notice that the external hex surface on the key and the internal hex recess in the key combine to hold the key against rotation relative to the holder. The holder is already restrained against rotation.

Exchange or replacement of the key is a simple matter. The spring is merely pivoted around its mounting bolt 50, to disconnect it from the holder. The key can then readily be pushed out and replaced with a new key or with a key of different size. Of course, the lateral dimensions of the key except for the wrench-engaging surfaces will be identical for all key sizes.

This invention thereby provides a convenient and strong tool, which can readily be fixed, and readily refitted to a different size.

This invention is not to be limited by the embodiment shown in the drawings and described in the description, which is given by way of example and not of limitation, but only in accordance with the scope of the appended claims.

I claim:

1. A tool for setting a threaded fastener with torque exerted at only one end, said tool comprising:

a body; a gear train said body adapted to receive and transmit torque from a power source; a socket in gear driving engagement with said gear train and mounted to said body for rotation around an axis, said socket having an internal non-circular array of fastener engaging surfaces and a central circular axial passage therethrough; a key holder having a circular external bearing surface fitted in said axial passage in the socket permitting free relative rotation between the key holder and the socket, said key holder having an internal key passage including a non-circular key-engaging portion and a shoulder; a key fitted in said passage, said key having an exterior non-circular portion to engage in said non-circular key passage portion, said key having a retained end and a free end, and an array of fastener engaging surfaces at the free end of said key; and a spring mounted to said body and exerting a bias on said key to bias the free end of the key away from said body, said spring having a free end engaged to said holder to restrain the key holder against rotation, and at least partially occluding the non-circular key passage to prevent removal of the key while the spring is in place, said free end being removable to enable removal or placement of the key from or into said key passage at the end of said passage respective to the retained end of said key.

2. A tool according to claim 1 in which the cross-section area of its fastener engaging array is significantly smaller than the cross-section area of the remainder of the key.

3. A tool according to claim 1 in which said spring is pivotally mounted to said body to enable it to be released from the key holder by rotating it around its attachment.

4. A tool according to claim 3 in which the cross-section are of its fastener engaging array is significantly smaller than the cross-section area of the remainder of the key.

* * * * *